US008347540B2

(12) United States Patent
Sirois

(10) Patent No.: US 8,347,540 B2
(45) Date of Patent: Jan. 8, 2013

(54) HANDGUARD SYSTEM FOR FIREARMS

(75) Inventor: Christopher M. Sirois, Newfields, NH (US)

(73) Assignee: Sig Sauer, Inc., Exeter, NH (US)

( * ) Notice: Subject to any disclaimer, the term of this patent is extended or adjusted under 35 U.S.C. 154(b) by 355 days.

(21) Appl. No.: 12/592,678

(22) Filed: Dec. 1, 2009

(65) Prior Publication Data

US 2011/0126443 A1 Jun. 2, 2011

(51) Int. Cl.
*F41A 21/00* (2006.01)

(52) U.S. Cl. ..... 42/75.01; 42/71.01; 42/72

(58) Field of Classification Search ..... 42/71.01, 42/72, 75.03, 75.01, 75.02; 403/362, 381; 285/419, 367

See application file for complete search history.

(56) References Cited

U.S. PATENT DOCUMENTS

| | | | | |
|---|---|---|---|---|
| 4,074,402 | A * | 2/1978 | Taketani | 24/268 |
| 4,834,186 | A * | 5/1989 | Ballard | 169/16 |
| 7,520,539 | B2 * | 4/2009 | Ignaczak et al. | 285/367 |
| 7,707,762 | B1 * | 5/2010 | Swan | 42/85 |

* cited by examiner

*Primary Examiner* — Daniel J Troy
(74) *Attorney, Agent, or Firm* — Bennet K. Langlotz; Langlotz Patent & Trademark Works, Inc.

(57) ABSTRACT

A handguard system for connecting an accessory to a firearm has a tubular body having a bore size to closely receive the body of the barrel nut. The tubular body has a tapered wedge portion that defines a gap therein. There may be a tapered clamp element adapted to fit over the wedge. The clamp element may be operable to squeeze the gap as the clamp element is pushed onto the wedge. The squeezing of the gap is operable to clamp the tubular body to the body of the barrel nut. The tubular body and the body of the barrel nut may each include a mating feature that prevents longitudinal movement of the tubular body while the mating features are engaged. The tubular body and the upper receiver may each include a mating feature that prevents rotational movement of the tubular body while the mating features are engaged.

8 Claims, 8 Drawing Sheets

HANDGUARD SYSTEM FOR FIREARMS

FIELD OF THE INVENTION

The present invention relates to firearms, and more particularly to facilities for mounting accessories to a firearm, such as optics, laser sights, lights, and cameras.

BACKGROUND OF THE INVENTION

Is often desirable to mount removable accessories to a firearm. Optics and laser sights improve the user's aim; a light enables the user to illuminate his/her surroundings; a camera enables the user to create a visual record of his/her environment.

Firearms have included handguards for many years to protect the user's hands from a hot barrel and to provide a secure gripping means. The four service rifles adopted by the United States armed forces during the twentieth century, the M1903, the M1 Garand, the M14, and the M16, incorporate handguards which make contact with the barrel at multiple locations. These conventional handguards, contacting the barrel in this manner, can transmit external forces to the barrel, sometimes reducing firearm accuracy.

Although these handguards function as intended, it has been well established in the field of competitive target shooting that rifles with barrels that are isolated or "float" without touching the two handguard ends provide superior shooting accuracy. Furthermore, handguards that do not touch the barrel at the front end of the handguard are less likely to conduct unwanted heat into the handguard.

The M16 rifle is a gas operated rifle adopted by the United States armed forces during the period 1962-63. Many variations have been produced since that time including civilian models for sporting uses such as target shooting competition.

The group of firearms generally considered "M16 style" includes gas operated rifles, carbines and pistols (essentially carbines without shoulder stocks) with common design features including a barrel which attaches with a barrel nut, and a gas tube and gas block which are part of the operating mechanism. More recently, pushrods have replaced gas tubes for some variations. The firearms have many designations including M16A2, AR15, M4, and the larger frame Armalite AR10 and its equivalents, which include a larger barrel, barrel nut, and other parts. The M16, M16A2, AR15, AR10, and M4 are all the same family of rifles all originally equipped with the old style (direct impingement) gas system. All of these rifles are capable of being upgraded to various types of piston gas systems by various manufacturers.

Most M16 style firearms produced have conventional, "non-floating" handguards. More recently there has been an increasing trend to issue floating handguard designs to selected military and law enforcement units.

Handguards designed to float the barrel are marketed by several terms, including "float tubes," "floating handguards," and "free float sleeves." Prior art floating handguard systems for M16 style firearms which have the potential for improved accuracy compared to conventional handguards include designs that mount to a floating handguard barrel nut that secures the barrel to the receiver. These designs do not attach at both ends of the handguard, unlike many conventional handguard designs.

Since the 1980's, development of firearm accessories related to optical, laser, and other rapid-growth technologies has resulted in an expansion of the handguard function to include serving as an interface for these devices.

More recently, secondary optics and gun sights, supplemental insulating handguards (handgrips), sling devices, and removable military standard rails have been proliferating and must be interfaced to the firearm, frequently being attached to a handguard rail by rail clamp devices integrated to the accessory. In addition, threaded holes and inserts in handguards allow accessory devices to be attached with screws. By providing this additional functionality, handguards have evolved to being more generally considered as handguard systems.

Prior handguard systems, although functional, have several important deficiencies:

(a) Some prior floating handguards are attached by a yoke that is locked on the barrel nut. The yoke stretches over time, and cannot be re-tightened once it has stretched beyond the limit of adjustment. Thereafter, the handguard loses its rigidity, which adversely affects the accuracy of optics attached to the handguard.

(b) Some handguards contact the barrel at both ends of the handguard, potentially causing impaired shooting accuracy and increased handguard heating.

(c) Many prior handguards do not have integral military standard Picatinny rails (MIL-STD-1913) or threaded holes, thus limiting their ability to mount accessories.

(d) Other prior art handguards suffer other disadvantages such as inadequate repeatable precision of alignment (which generates shooting inaccuracy), complexity and cost of manufacture, and durability.

It is therefore an object of this invention to provide a handguard system that provides a secure and mechanically strong mounting system for accessories such as optics, laser sights, lights, and cameras to a firearm, and that secures the accessory to the firearm regardless of vibrations from firing of the rifle.

SUMMARY OF THE INVENTION

The present invention provides an improved handguard system, and overcomes the above-mentioned disadvantages and drawbacks of the prior art. As such, the general purpose of the present invention, which will be described subsequently in greater detail, is to provide an improved handguard system that has all the advantages of the prior art mentioned above.

To attain this, the preferred embodiment of the present invention essentially comprises a handguard system for connecting an accessory to a firearm that has a tubular body having a bore size to closely receive the body of the barrel nut. The tubular body has a tapered wedge portion that defines a gap therein. There may be a tapered clamp element adapted to fit over the wedge. The clamp element may be operable to squeeze the gap as the clamp element is pushed onto the wedge. The squeezing of the gap is operable to clamp the tubular body to the body of the barrel nut. The tubular body and the body of the barrel nut may each include a mating feature that prevents longitudinal movement of the tubular body while the mating features are engaged. The tubular body and the upper receiver may each include a mating feature that prevents rotational movement of the tubular body while the mating features are engaged. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
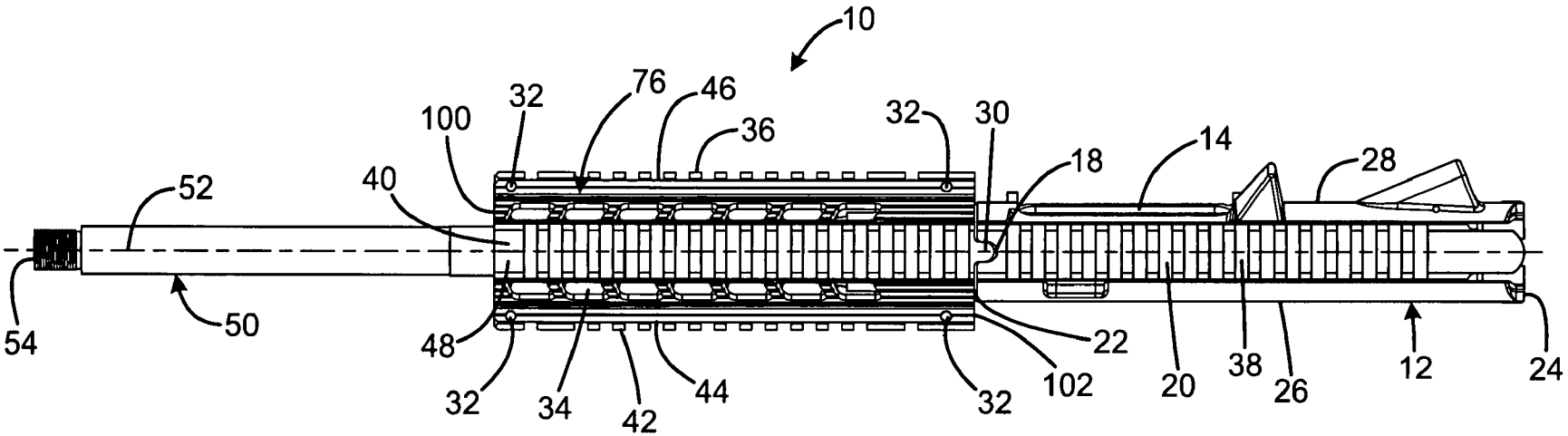
FIG. 1 is a top view of the current embodiment of the handguard system constructed in accordance with the principles of the present invention installed on the upper receiver and gun barrel of a rifle.

A preferred embodiment of the handguard system of the present invention is shown and generally designated by the reference numeral 10.

Figure 2:
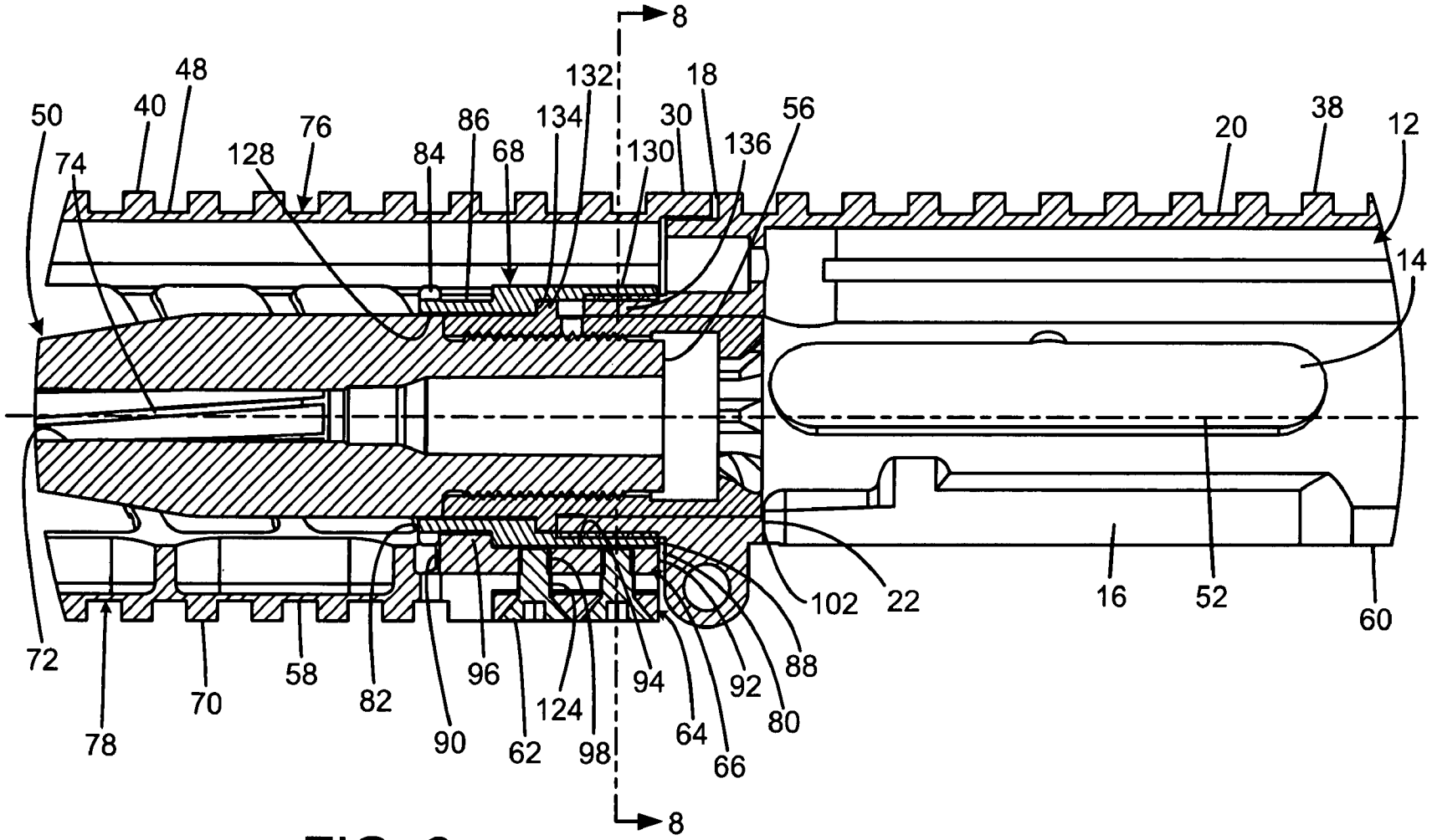
FIG. 2 is a left side sectional view of the current embodiment of the handguard system of the present invention installed on the upper receiver and gun barrel of a rifle.

FIGS. 1 and 2 illustrate the improved handguard system 10 of the present invention installed on the upper receiver 12 and gun barrel 50 of a rifle. More particularly, the barrel has a forward muzzle end 54, a rear end 56 with a circumferential flange 132, a central bore 72 with rifling 74, and a barrel axis 52 defined by the central bore.

The upper receiver has a forward end 22, a rear end 24, a top 20, a bottom 60, a left side 26, and a right side 28. The top forms an accessory rail 38 whose forward end terminates in an alignment groove 18. Although the groove is depicted as being radiused, it can be any shape that will prevent rotational movement about the barrel axis of an element inserted therein. The right side defines an elongated aperture that forms an ejection port 14. The bottom defines a rectangular aperture that forms a magazine well 16. The forward end terminates in a sleeve 136 that receives the rear end of the gun barrel. The handguard system is attached to the forward end of the upper receiver by clamping around a barrel nut 68 that encircles the rear end of the gun barrel and is removably attached to the upper receiver's sleeve by threads.

Figure 3:
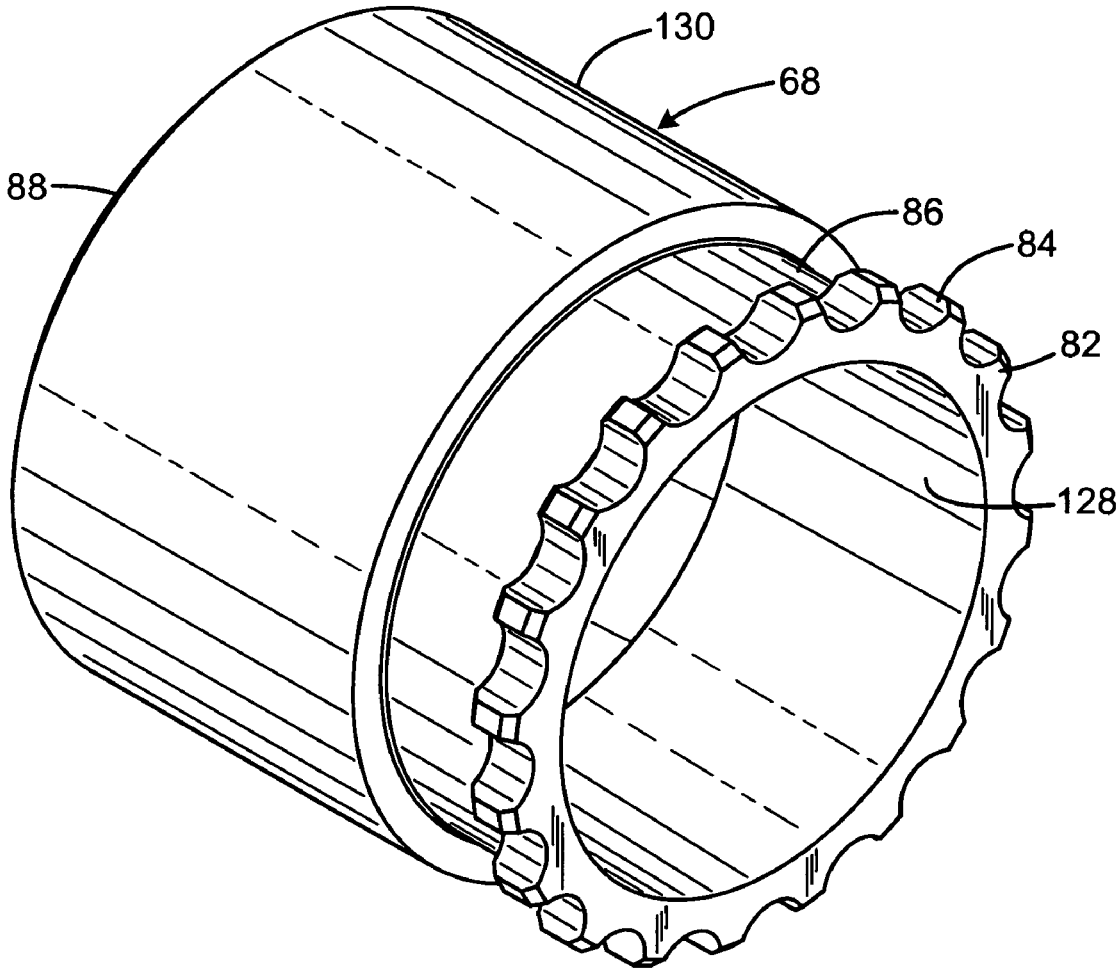
FIG. 3 is a front perspective view of the current embodiment of the barrel nut of the present invention.

FIGS. 2 and 3 illustrate the barrel nut of the current invention. The barrel nut serves as a connection facility to provide a secure, reliable, repeatable, and rigid connection between the rear end of the gun barrel and the forward end of the upper receiver. The steel barrel nut is 1.4375 inches long (in one variation) and includes a tubular body 130. The body has a front end 82, a rear end 88, and a central bore 128. The front end terminates in a standard 20 point "star" tool adapter 84. In one variation the tool adapter supports existing and readily available tools for barrel installation. A groove 86 is present on the body immediately behind the tool adapter. The front end of the bore is smooth to receive the rear end of the gun barrel. The rear end of the bore is threaded to removably connect the barrel nut to the sleeve on the front end of the upper receiver. The front end of the bore has a narrower diameter than the rear end of the bore, which forms a circumferential shoulder 134 where the diameter transition occurs. When the barrel nut is tightened, the shoulder clamps the gun barrel's flange against the upper receiver's sleeve, which prevents longitudinal axial movement of the gun barrel.

Figure 4:
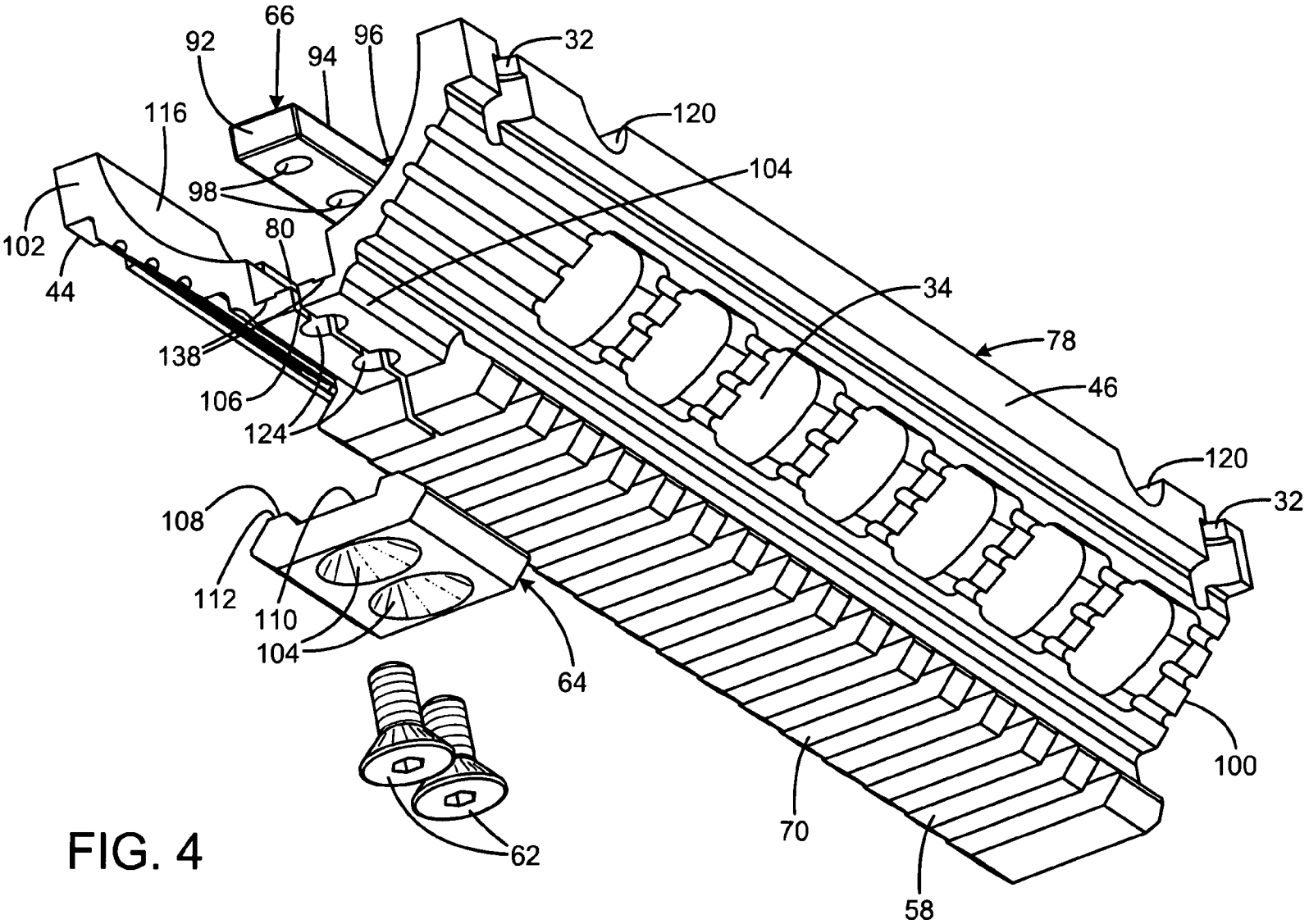
FIG. 4 is a bottom rear perspective exploded view of the current embodiment of the lower quad rail, clamp key, and clamp cap of the present invention.
Figure 5:
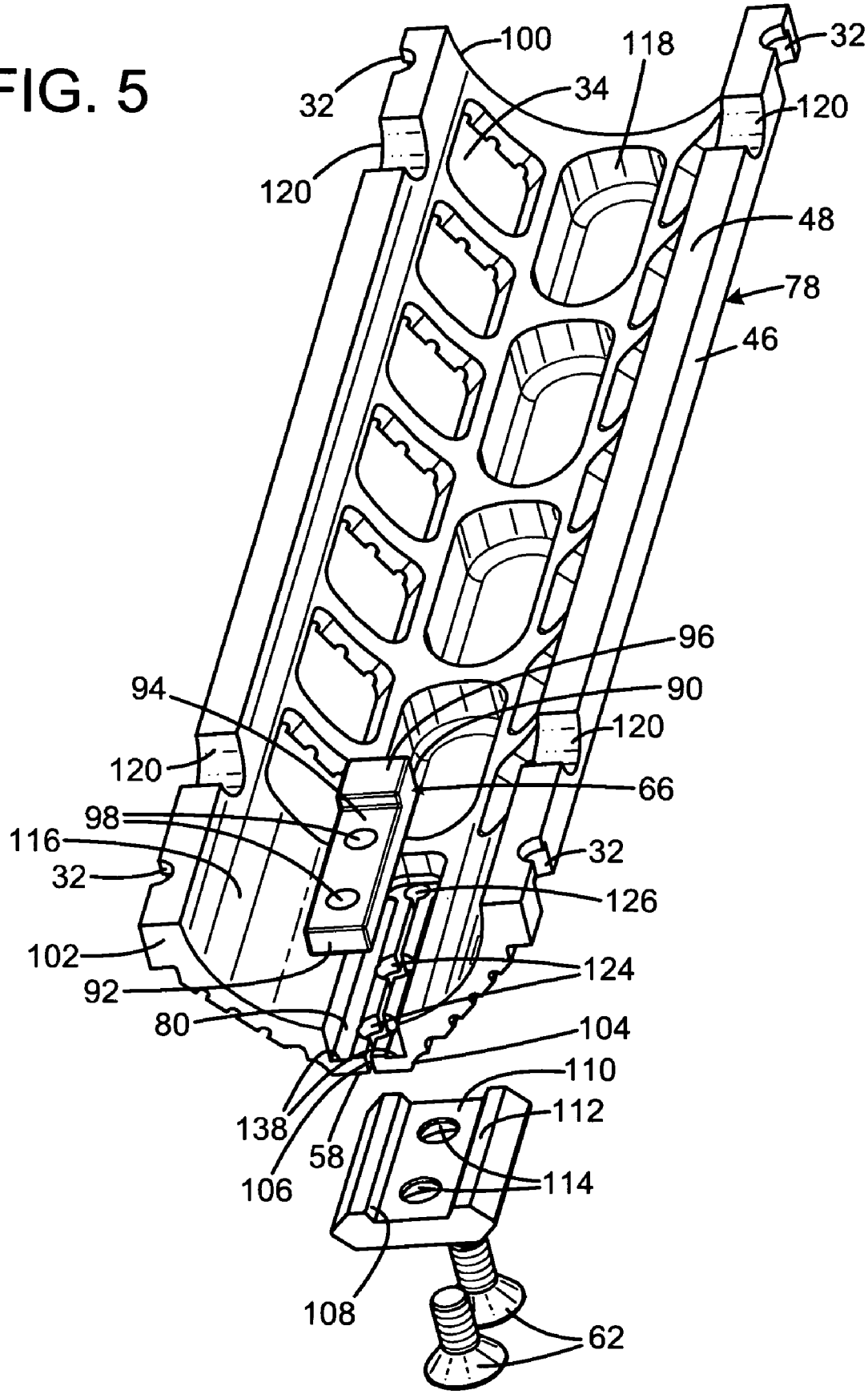
FIG. 5 is a top rear perspective exploded view of the current embodiment of the lower quad rail, clamp key, and clamp cap of the present invention.
Figure 6:
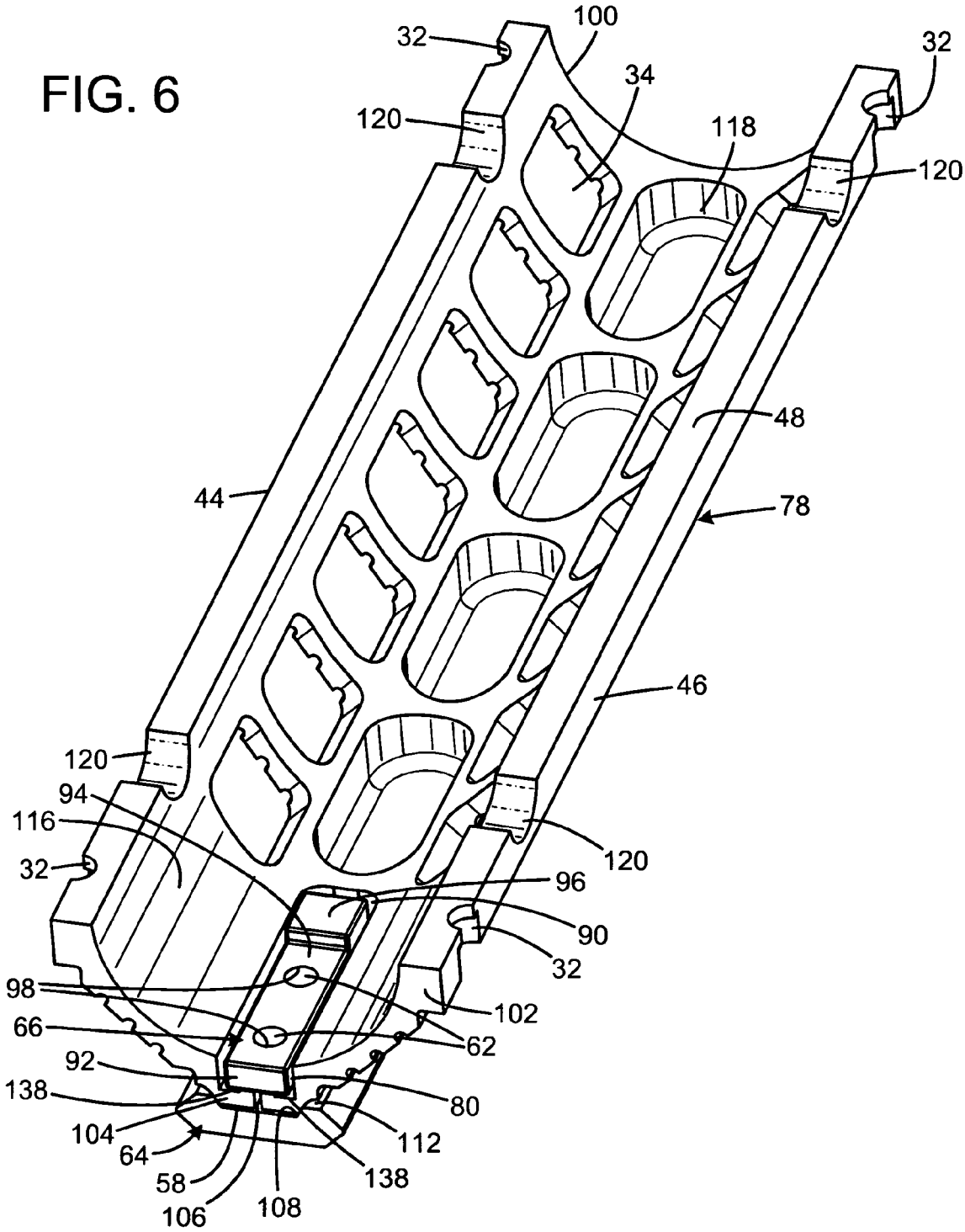
FIG. 6 is a top rear perspective view of the current embodiment of the lower quad rail, clamp key, and clamp cap of the present invention.

FIGS. 4-6 show the lower quad rail 78 and the clamping components of the handguard system 10. The aluminum lower quad rail is a generally hollow semi-cylindrical form having an interior sidewall 116. The interior sidewall is smooth and is adapted to closely fit the body of the barrel nut. The lower quad rail defines four bolt holes 32 and four accessory mount holes 120 at the front 100 and rear 102 of its left 44 and right 46 sides. The accessory mount holes are adapted to receive sling swivel attachments. A plurality of lightening holes 34 pierce its left and right sides, and a plurality of lightening pockets are present in its bottom 58. The lightening holes and lightning pockets reduce the weight of the lower quad rail, and provide ventilation to facilitate barrel cooling. The lower quad rail's bottom 58 terminates in an accessory rail 70.

The bottom rear of the lower quad rail's interior sidewall defines a clamp key pocket 80. The bottom of the clamp key pocket defines an axial slot 106, two screw holes 124, and two axial clearance slots on either side of the screw holes 124. The axial slot runs parallel to the barrel axis and terminates in a stress relief hole 126 at its front end. The exterior sidewalls of the rear of the bottom of the lower quad rail are tapered outwards at about a 30° angle to form a wedge 104.

The clamp key pocket receives a steel clamp key 66, which features a key 96 on the top 94 of its front end 90. The rear 92 of the clamp key is flush with the rear of the lower quad rail, and two threaded screw holes 98 through the clamp key are aligned with the screw holes 124 in the bottom of the lower quad rail.

A hardened steel clamp cap 64 defines a groove 110 in its top 112. The interior sidewalls 108 of the groove are tapered at about a 30° angle to closely fit the tapered exterior sidewalls 104 on the lower quad rail. The clamp cap has two countersunk screw holes 114 that are aligned with the screw holes 124 in the lower quad rail. Two #10-32 flathead screws 62 pass through the screw holes 114 and 124 and their threaded ends are received by the screw holes 98 in the clamp key to secure the clamp cap over the lower quad rail's wedge. The clamp cap has a Picatinny rail profile.

Figure 7:
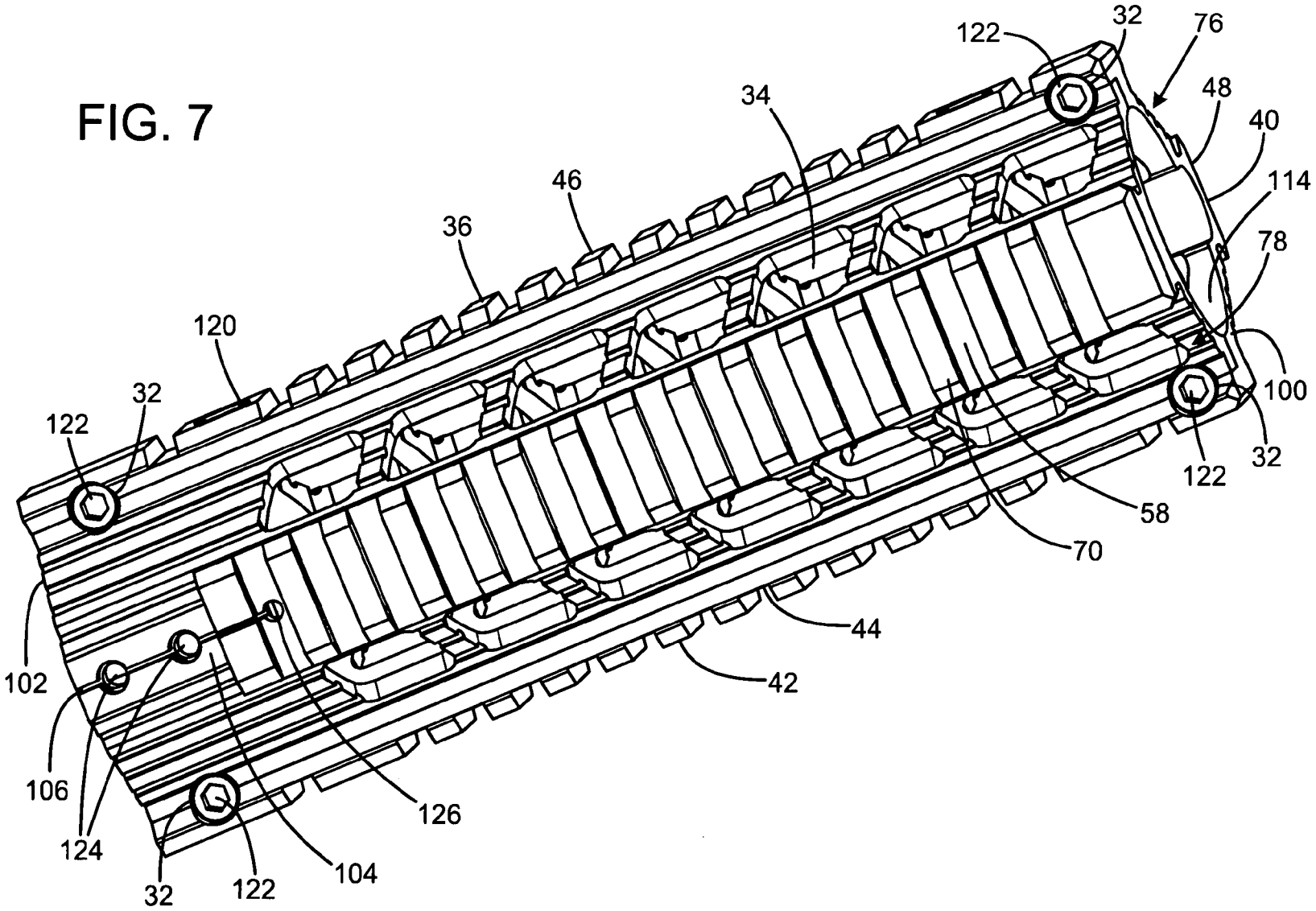
FIG. 7 is a bottom rear perspective view of the current embodiment of the lower quad rail and upper quad rail of the present invention.

FIGS. 1 and 7 depict the upper quad rail 76 attached to the lower quad rail. The main portion of the handguard system 10 is an upper quad rail that is a generally hollow semi-cylindrical form having an interior sidewall 114. The interior sidewall is smooth and is adapted to closely fit the body of the barrel nut. The upper quad rail defines four bolt holes 32 and four accessory mount holes 120 at the front 100 and rear 102 of its left 44 and right 46 sides. A plurality of lightening holes 34 pierces its left and right sides. The lightening holes reduce the weight of the upper quad rail. The upper quad rail's top 48, left side 44, and right side 46 terminate in accessory rails 40, 42, and 36. The rear end of the accessory rail 40 terminates in an alignment key 30. Although the alignment key is depicted as being radiused, it can be any shape that will prevent rotational movement about the barrel axis when it is inserted into the alignment groove 18 in the upper receiver. Four bolts 122, which are #10-32 cap screws in the current embodiment, are inserted through the bolt holes 32 to removably attach the upper quad rail to the lower quad rail. Threaded inserts in the upper quad rail receive the threaded ends of the bolts 122.

Figure 8:
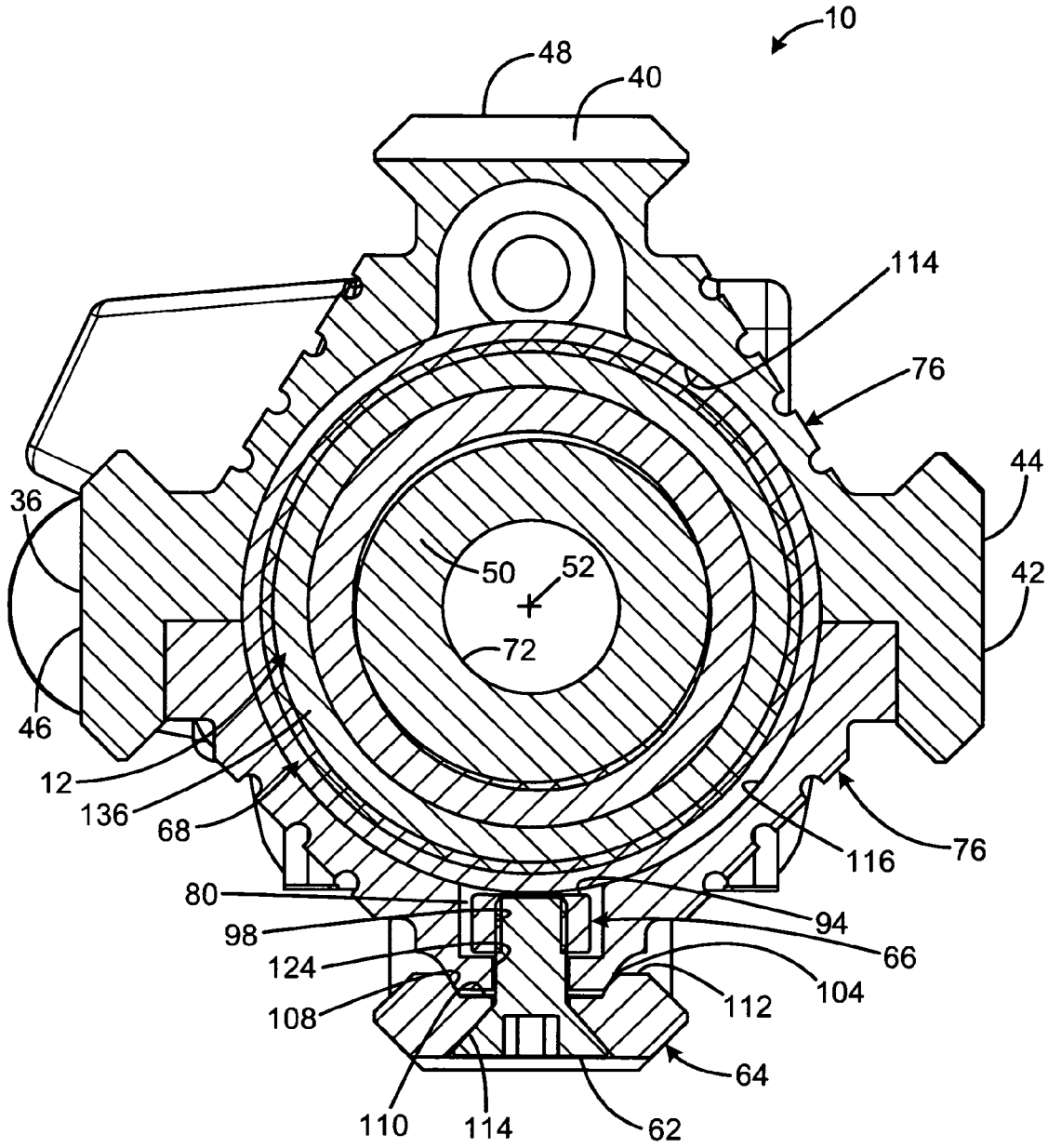
FIG. 8 is a rear sectional view of the current embodiment of the handguard system of the present invention installed on the upper receiver and gun barrel of a rifle.

FIG. 8 shows the current embodiment of the handguard system 10 in an installed condition to illustrate the clamping action. The rear end of the barrel nut is screwed onto the sleeve of the upper receiver using the tool adapter to secure the rear end of the gun barrel to the forward end of the upper receiver. The upper quad rail has been joined to the lower quad rail by the bolts 122 so the interior sidewalls of the rear end of the upper and lower quad rails closely fit against the body of the barrel nut. The quad rails are positioned over the barrel and barrel nut so the alignment groove receives the alignment key protruding rearwardly from the top of the upper quad rail. As the clamp cap is tightened against the lower quad rail by the screws 62, the slot 106 is squeezed, which tightens the interior sidewalls 116 of the lower quad rail against the body of the barrel nut. This clamps the barrel nut between the upper quad rail and the lower quad rail, creating a rigid attachment between the barrel nut and the handguard system 10. The amount of clamping force exerted by the clamp cap is variable based on the extent to which the screws are tightened and the slot is closed.

In this condition, the handguard cannot rotate about the barrel axis because the alignment groove 18 retains the alignment key 30. The handguard cannot move axially because the key portion of the alignment key is retained by the groove in the barrel nut. These constraints provide a rigid and repeatable alignment between the handguard and the gun barrel. Moreover, the tapered engagement of the clamp cap with the split wedge portion of the lower quad rail serves to accommodate any wear, avoiding loosening of the fit over time.

The clamp key does not fit tightly in the clamp key pocket, to permit the slot to be squeezed closed by the clamp cap. The clearance slots on either side of the slot prevent the clamp key from contacting the corners of the clamp key pocket, which prevents the lower quad rail from deforming at those corners, which might otherwise create a step in the bottom surface that could prevent future tighter clamping. Since the steel clamp key and clamp cap are compressing the softer aluminum lower quad rail, any deformation will occur at the portion of the lower quad rail directly beneath the clamp key.

Removal or uninstallation of the handguard from the upper receiver and gun barrel follows the reverse process. The screws 62 must be unscrewed sufficiently to allow the slot 106 to widen and enable the interior sidewalls of the quad rails to clear the barrel nut. Only then can the quad rails can then be separated by unscrewing the bolts 122 to facilitate their removal from the barrel nut and gun barrel. As a quad rails are removed, the alignment key of the upper quad rail is withdrawn from the alignment groove in the upper receiver, and the key portion of the clamp key is withdrawn from the groove on the body of the barrel nut.

By fixing the orientation of the accessory rails with respect to the gun barrel using the handguard system, the accuracy of the rifle with a sighting accessory installed is assured despite multiple cycles of installation and removal of the handguard. In order for the handguard system to be practical, a single sight-in session when the accessory is installed on the handguard system for the first time must be all that is required to ensure the rifle's accuracy.

In the context of the specification, the terms "rear" and "rearward" and "front" and "forward" have the following definitions: "rear" or "rearward" means in the direction away from the muzzle of the firearm while "front" or "forward" means it is in the direction towards the muzzle of the firearm; "longitudinal" means in the direction of or in parallel with the longitudinal axis of the barrel while "transverse" means in a direction perpendicular to the longitudinal direction.

In use, an accessory device such as a laser sight is attached to the handguard system after the handguard system is mounted on a firearm. The handguard system and upper quad rail and a lower quad rail that are joined to closely fit the body of a barrel nut. A clamp key is positioned in a clamp key pocket in the rear of the lower quad rail in axial alignment with a groove in the body of the barrel nut. A clamp cap is positioned in axial alignment with the clamp key such that a groove in the top of the clamp cap receives a wedge protruding from the rear of the lower quad rail. Screw holes in the clamp key, wedge, and clamp cap are transversely aligned so that two screws can tighten the clamp cap against the wedge.

When attaching the handguard system onto the barrel nut, the screws in the clamp cap are loosened so that the slot in the wedge is uncompressed. This ensures that the lower quad rail can be placed on the body of the barrel nut without impediment from the body of the barrel nut.

The handguard system is placed on the barrel nut by inserting the barrel nut between the upper and lower quad rails by squeezing the upper and lower quad rails together. The barrel nut is received by the interior sidewalls of the upper and lower quad rails. The squeezing movement continues until the alignment key is aligned with and received by the alignment groove in the upper receiver, the key portion of the clamp key is aligned with and received by the groove on the body of the barrel nut, and the bolt holes in the upper and lower quad rails are axially registered with one another.

At this stage, the bolts are inserted into the bolt holes and tightened to secure the upper quad rail to the lower quad rail. Then, the screws in the clamp cap are tightened down to cause the clamp cap to exert a clamping action on the wedge by squeezing the slot. Once the attachment has been completed, the handguard system is secured to the barrel nut an upper receiver in both longitudinal and rotational axes.

To remove the handguard system from the barrel nut, the screws in the clamp cap are first loosened to release the clamping pressure from the wedge. Once the slot has opened, the interior sidewalls of the upper and lower quad rails are disengaged from the body of the barrel nut. The bolts connecting the upper and lower quad rails together can then be unscrewed and removed so the upper and lower quad rails can be separated and lifted away from the barrel nut and barrel. The handguard system is then removed from the barrel nut until the alignment key is removed completely from the alignment groove and the key portion of the clamp key is removed completely from the groove in the body of the barrel nut.

The handguard system thus described provides for a quick and easy, yet reliable and mechanically strong attachment system for accessory devices, such as optics, laser sights, lights, and cameras, to be attached to a firearm.

While a current embodiment of the handguard system has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, while a clamp cap is described as the preferred clamping element that is attached to the wedge disclosed herein, other clamping devices such as hose clamps, or cross screws may also be used to provide a clamping action to close the wedge's slot. Furthermore, although a 30° angle of taper of the wedge and clamp cap groove has been described, any suitable angle could be utilized that will cause the clamp cap to exert a clamping action on the wedge. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A mounting facility for connection to a firearm with a barrel extending to define a forward direction, a rear end of the barrel being received by a forward end of an upper receiver, and a barrel nut having a body removably securing the rear end of the barrel to the forward end of the upper receiver, the facility comprising:

a tubular forestock having a bore sized to closely receive the body of the barrel nut;

the tubular forestock having a tapered wedge portion;

the tapered wedge portion defining a gap therein;

a tapered clamp element adapted to fit over the wedge;

the clamp element being operable to squeeze the gap as the clamp element is pushed onto the wedge; and the squeezing of the gap being operable to clamp the tubular forestock to the body of the barrel nut;

wherein the body of the barrel nut includes a mating feature;

wherein the tubular forestock includes a mating feature that is intended to engage the mating feature on the body of the barrel nut, the mating features preventing longitudinal movement of the tubular forestock while the mating features are engaged with one another; and wherein the clamp element and wedge portion each include a screw hole that receives a screw, the screw pushing the clap element onto the wedge portion when the screw is tightened.

2. The facility of claim 1 wherein the clamp element includes a groove with tapered sidewalls that engage the tapered wedge portion.

3. The facility of claim 1 wherein the gap defines a stress relief hole at one end.

4. The facility of claim 1 wherein the mating feature on the body of the barrel nut is a circumferential groove, and wherein the mating feature on the tubular forestock is a clamp key that protrudes into the bore and engages the groove on the body of the barrel nut.

5. The facility of claim 1, wherein the barrel defines a barrel axis, and wherein the screw extends radially outward from the barrel axis.

6. A method of removably securing a mounting facility to a firearm with a barrel extending to define a forward direction, a rear end of the barrel being received by a forward end of an upper receiver, a barrel nut having a body removably securing the rear end of the barrel to the forward end of the upper receiver, comprising the steps:

providing a forestock body having a bore sized to closely receive the body of the barrel nut;

providing a tapered wedge attached to the forestock body;

providing a gap in the wedge;

providing a clamping mechanism that fits over the wedge and squeezes the gap as the clamping mechanism is pushed onto the wedge, the squeezing of the gap being operable to clamp the forestock body to the body of the barrel nut;

loosening the clamping mechanism;

inserting the body of the barrel nut into the bore;

moving the forestock body in a rearward direction until a rear portion of the forestock body is obstructed by the forward end of the upper receiver;

tightening the clamping mechanism, thereby clamping the forestock body to the body of the barrel nut; and wherein the clamping mechanism includes a clamp element having a groove with tapered sidewalls that engage the tapered wedge portion, and the clamp element and wedge portion each include a screw hole that receives a screw, the screw pushing the clamp element onto the wedge portion when the screw is tightened.

7. The method of claim 6 wherein the body and the forward end of the upper receiver each include a mating feature, the mating features preventing rotational movement of the forestock body about the barrel while the mating features are engaged with one another.

8. The method of claim 6 wherein the forestock body and the body of the barrel nut each include a mating feature, the mating features preventing forward movement of the body while the mating features are engaged with one another.

* * * * *